US010614746B2

(12) United States Patent
Peng

(10) Patent No.: US 10,614,746 B2
(45) Date of Patent: Apr. 7, 2020

(54) AUTOMATIC GAMMA CURVE SETTING METHOD FOR MONITOR

(71) Applicant: DIVA Laboratories, Ltd., New Taipei (TW)

(72) Inventor: Chuan-Ling Peng, New Taipei (TW)

(73) Assignee: DIVA LABORATORIES, LTD., New Taipei (TW)

( * ) Notice: Subject to any disclaimer, the term of this patent is extended or adjusted under 35 U.S.C. 154(b) by 0 days.

(21) Appl. No.: 16/209,099

(22) Filed: Dec. 4, 2018

(65) Prior Publication Data

US 2020/0051487 A1 Feb. 13, 2020

(30) Foreign Application Priority Data

Aug. 7, 2018 (TW) ..... 107127387 A

(51) Int. Cl.
*G09G 5/10* (2006.01)
*G09G 3/20* (2006.01)

(52) U.S. Cl.
CPC ..... *G09G 3/2092* (2013.01); *G09G 2310/027* (2013.01); *G09G 2320/029* (2013.01); *G09G 2320/0276* (2013.01); *G09G 2320/041* (2013.01); *G09G 2320/0666* (2013.01); *G09G 2320/0673* (2013.01); *G09G 2320/08* (2013.01)

(58) Field of Classification Search
CPC ..... G09G 3/2092; G09G 2310/027; G09G 2320/0276; G09G 2320/029
USPC ..... 345/690
See application file for complete search history.

(56) References Cited

U.S. PATENT DOCUMENTS 6,593,934 B1 * 7/2003 Liaw ..... G09G 3/2092 345/590
2008/0158121 A1 * 7/2008 Liu ..... G09G 3/006 345/89
2010/0142838 A1 * 6/2010 Ivansen ..... G03F 7/70291 382/243
2016/0350940 A1 * 12/2016 Wang ..... G06T 5/009

* cited by examiner

*Primary Examiner* — Jonathan M Blancha
(74) *Attorney, Agent, or Firm* — Muncy, Geissler, Olds & Lowe, P.C.

(57) ABSTRACT

An automatic gamma curve setting method for the display is provided, which can automatically detect the input image as a grayscale image or a color image, and classify the input image as a grayscale image or a color image according to the image value, and automatically perform the corresponding Gamma curve to provide a diagnostic platform for the user to make a correct judgment through the correct image presentation.

11 Claims, 2 Drawing Sheets

AUTOMATIC GAMMA CURVE SETTING METHOD FOR MONITOR

CROSS-REFERENCE TO RELATED APPLICATIONS

This application claims priority to Taiwan Patent Application No. 107127387, filed on Aug. 7, 2018, the content of which are hereby incorporated by reference in their entirety.

FIELD OF THE INVENTION

The present invention relates to a medical display technology, particularly relates to the monitor with composite images is calibrated by using an automatic Gamma curve settings and color temperature.

BACKGROUND OF THE INVENTION

Generally, the medical monitors are generally classified into three categories: diagnostics, operating room, and teaching. The diagnostic displays often require the characteristic such as high resolution and high brightness, and are adjusted by Digital Imaging and Communications in Medicine (DICOM, hereinafter referred to as DICOM). The display device in the operating room is disposed toward the front-end imaging device such as the endoscope, so as to allow the display device in the operating room to be a surgical auxiliary information display device that conforms to the characteristics of the image device. The characteristics of the image device, for example, the moderate resolution and the brightness which are required to calibrate by Gamma calibration.

The users of medical monitors, such as radiologists, often have to view various patient data, such as CT/MRI images, the medical records, or the surgical images. In addition to common gray scale images, many image processing technologies are increasingly used in medical applications, such as endoscope system imaging, 3D imaging, color MRI imaging, PET pseudo color imaging, etc., and these image data are all colored.

However, the various types of data, such as gray scale images, the color images, text, graphics, and audio, must be accurately visualized and displayed for diagnosis by the user such as a doctor. To compare with a gray scale image, a color image is an image with multiple colors, which is the total set of gray scale images. If it is represented by an RGB color space, the values of the three components can be varied within a certain range. The gray scale image is one of the color images and is a subset of the color image. The three components of RGB are exactly the same.

The typical gray scale monitor cannot display any color image data. If the color monitor is used to display color images and the gray scale images simultaneously, a single calibration method may cause the distortion of one of the images, which may affect the correctness of the diagnosis. This will make many diagnostic platform equipped with multiple monitors with different characteristics, that is, by using two high-resolution, high-brightness, DICOM-adjusted gray scale, and an additional color monitor with low-resolution, low-brightness and Gamma calibration to control and display the different data to meet the needs of accurate diagnostics.

In addition, in the prior art, the medical monitor can only select the full screen to execute the DICOM curve or the Gamma 2.2 curve when the image is displayed. If the image is a composite image, that is, the composite image includes the gray scale and the color image. The gray scale image must be grayed out according to the gray scale. The definition of the GSDF (Gray scale standard display function) in DICOM Part14. If the gray scale image is subjected to the Gamma 2.2 curve, the image will be too bright and the dark details will be lost. The display result of this image may result in the error in the diagnosis of the disease. Similarly, if the medical color image performs with a DICOM curve, it will cause the image to be too dark, the contrast of the color to decrease, and the color error of the real image to be too large.

SUMMARY OF THE INVENTION

According to the prior art, the drawback of the medical monitor is that can only select a single method of calibrating image when the composite images is displayed. The major objective of the present invention is to provide a method for automatically detecting whether the input image is the gray scale image or the color image, determining whether the input image is gray scale image or the color image to classify according to the image value, and automatically performing the corresponding Gamma curve to provide a diagnostic platform for the user to make the correct judgments through the correct image presentation on the medical monitor.

Another objective of the present invention is to perform an image adjustment on a panel through a light sensor.

A further objective of the present invention is to instantly determine whether the input image is the gray scale, the color image or the composite image, and to perform the corresponding Gamma curve and the color temperature value, so that the outputted image has the best image display without delay when the image is outputted.

Another further objective of the present invention is to provide an image highlight function, which allows the user to clearly view whether the video image is clearly classified to the gray scale image or the color image, so as to the display screen can correctly display the input image that is determined instantly whether the gray scale image or the color image. Thus, the display screen can be displayed the video image through the image highlight enable value to allow the user to view only the gray scale image or the color image.

According to above objectives, the present invention provides an automatic Gamma curve setting method. The method includes: providing an input image by a display panel, in which the input image includes a plurality of pixels, and the input image is inputted by the display panel; determining the correlation between R (red) value, G (green) value, and B (blue) value of each the plurality of pixels of the input image to judge whether each of the plurality of pixels is a gray scale or not, if the pixels is determined as the gray scale, then the pixels is labeled with a gray scale flag, and the value of the gray scale flag is set to 1, so that each pixels of the input image has its corresponding gray scale flag value; calculating a gray scale consecutive maximum end value of the plurality of pixels of the input image to count the number of the gray scale flag value of 1, if the gray scale flag value of the pixels is not 1, the total number of the gray scale flag value of each pixels of the input image are returned to zero before the pixel with the gray scale flag value is not 1, and from the next pixel with the gray scale flag value is not 1 to re-calculate the gray scale consecutive maximum end value of the plurality of pixels of the input image; determining the input image as a consecutive number of pixels are labeled with the gray scale flag value according to a data sensitivity and normalizing a gray scale block to the number of pixels of the input image, when the data sensitivity is smaller, the gray scale block belongs to the input image is more smaller, else when the data sensitivity is larger, then the gray scale block belongs to the input image is more larger, and when the gray scale consecutives maximum end value is larger than or equal to the data sensitivity, then a gray scale enable value of the input image is set to 1; determining an automatic Gamma enable value and an image highlight enable value of the input image, if the automatic Gamma enable value is 1 and the image highlight enable value is 0, the automatic Gamma calibration function imaging is maintained on an execution screen of the display, if the automatic Gamma enable value is 1 and the image highlight enable value is 1, then the input image on the execution screen of the display belongs to a gray scale image that is maintained under an original brightness of the input image, and the remaining color images of the input image is reduced by 50% brightness; if the automatic Gamma enable is 1 and the image highlight enable value is 2, then the input image on the execution screen of the display belongs to a color image that is maintained under an original brightness of the input image, and the remaining gray scale images of the input image is reduced by 50% brightness; and performing different Gamma DICOM curve operations and different color temperature operations on the execution screen of the display according to the gray scale enable value, so that the input image is processed to become an image data that is conformed to a curve and a standard, and an adjusted image is transmitted to an image output unit to display an outputted image which is adjusted by the Gamma curve on the same execution screen of the display.

According to above objectives, the present invention further provides an automatic Gamma curve setting system that is applied for the monitor, which includes an image input unit, an image processing unit and an image output unit, in which the image input unit is a display panel that is provided for inputting an image, and the image can be a color image, a gray scale image or a composite image has both color and gray scale images. The image processing unit utilizes an automatic Gamma curve setting method to determine the input image whether is the gray scale image, the color image, or the composite image, and to perform the Gamma curve value and the color temperature value which are corresponding to the input image, so that the outputted image has the best image when the image is outputted without delay. The image output unit can be a display panel which is provided for displaying the calibrated image which is calibrated by the automatic Gamma curve setting method.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Some sample embodiments of the invention will now be described in greater detail. Nevertheless, it should be recognized that the present invention can be practiced in a wide range of other embodiments besides those explicitly described, and the scope of the present invention is expressly not limited except as specified in the accompanying claims.

Figure 1:
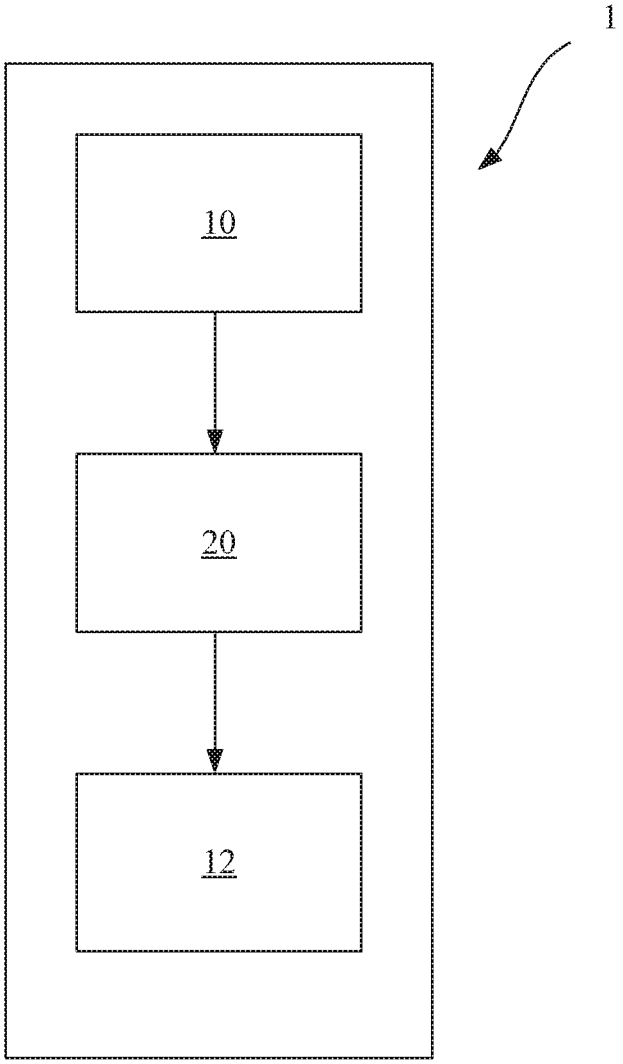
FIG. 1 is a block diagram showing an automatic Gamma curve setting method applied for monitor in accordance with the present invention.

Please refer to FIG. 1. FIG. 1 is a block diagram showing an automatic Gamma curve setting method applied for the monitor of the present invention. In FIG. 1, the Gamma curve setting system applied for the monitor 1 includes an image input unit 10, an image processing unit 20, an image output unit 12, a processor 30 and a calibration controller 40. The image input unit 10 is an image source for inputting the image, in which the image may be a color image, a gray scale image or a composite image includes both a color image and a gray scale image. The image processing unit 20 is provided for detecting and receiving the input image that is transmitted from the image input unit 10, and the image processing unit 20 is also provided for calibrating the input image by using Gamma curve. In the embodiment of the present invention, the image input unit 10 can be a graphic card or an endoscope that is connected to the monitor, but the types of the image input unit 10 are not limited in this present invention. If the input image is the gray scale image, the image processing unit 20 performs with the DICOM Part14 Gamma curve to the input image; else if the input image is the color image, the image processing unit 20 performs with the Gamma 2.2 curve to the input image. In this embodiment of the present invention, the image output unit 12 can be a display which is provided for outputting the image which is calibrated by the Gamma curve to solve the gray scale monitor and the color image monitor are both used simultaneously in some medical equipment to place many monitors in the diagnosis and treatment platforms such as an operating room, to cause the space of the diagnosis and treatment platform is not enough, and the problems of the varies monitors with different resolutions to result the user such as the doctor to make the misjudgment that can also be solved. In addition, the function and operations of the image processing unit 20, the processor 30 and the calibration controller 40 will be described in detail below.

Figure 2:
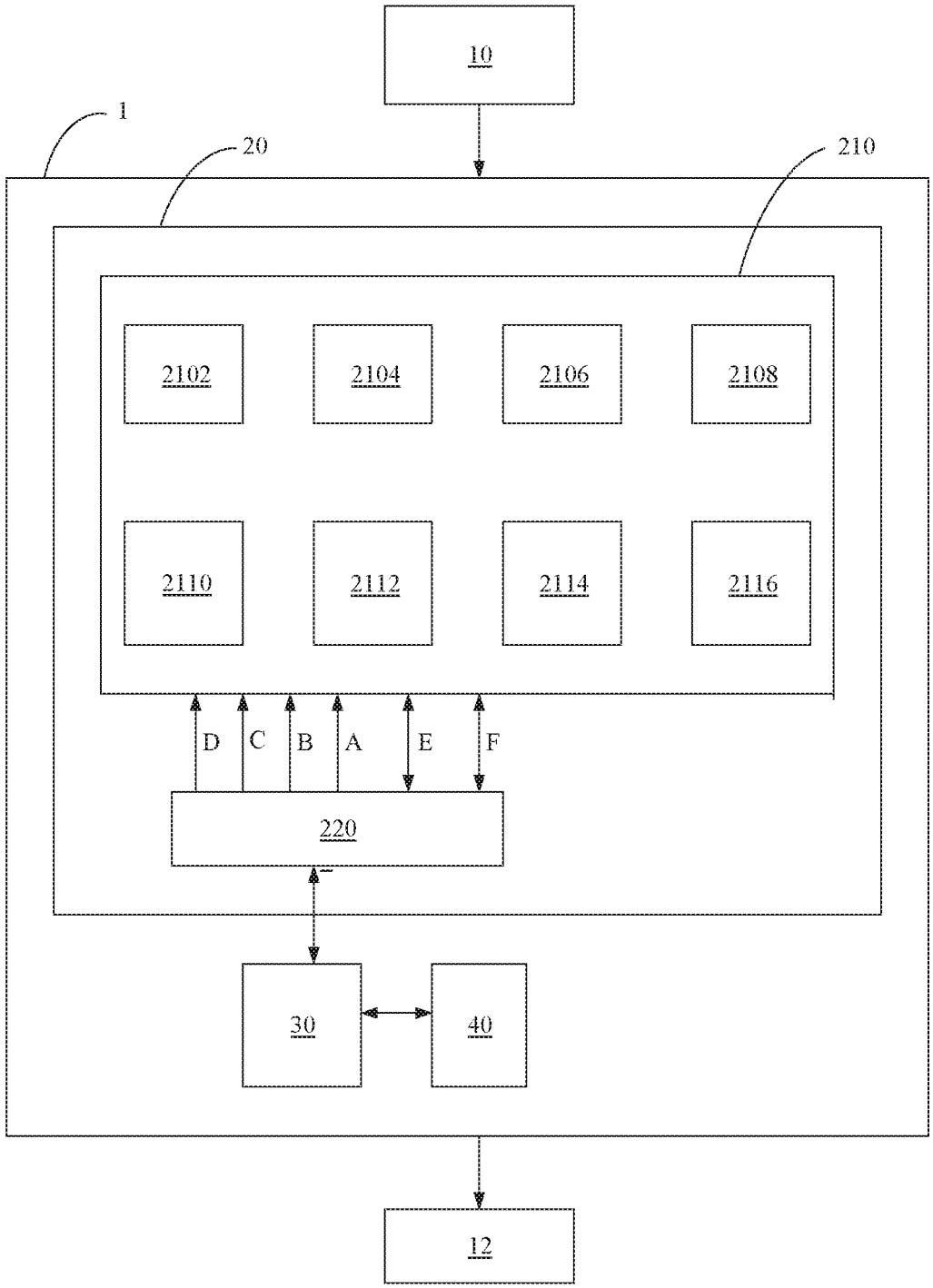
FIG. 2 is a block diagram showing an automatic Gamma curve setting method applied for an image processing unit in the monitor in accordance with the present invention.

Next, please refer to FIG. 2. FIG. 2 is a block diagram showing an automatic Gamma curve setting method applied for an image processing unit in the display. In FIG. 2, an image processing unit 210 of the processing unit 20 includes a RGB data decision module 2102, an undithering processing module 2104, a color temperature module 2106, an image highlight data module 2108, a mono data sensitivity decision module 2110, a Gamma look-up table (hereinafter refers to Gamma LUT) 2112, a Gamma DICOM look-up table (hereinafter refers to Gamma DICOM LUT) 2114, and a line buffer 2116. The image processing unit 210 of the processing unit 20 further includes an external bus interface (hereinafter refers to flex bus) 220 which is provided for connecting the microprocessor (not shown), in which the RGB data decision module 2102, the undithering processing module 2104, the color temperature module 2106, the image highlight data module 2108, the mono data sensitivity decision module 2110, the Gamma LUT 2112, the Gamma DICOM LUT 2114 and the line buffer 2116 are image line data access memory which is provided for connecting the above modules each other. Accordingly, in one preferred embodiment of the present invention, the image processing unit 20 provided for calibrating and adjusting the input image may be a field programmer gate array (hereinafter refers to FPGA).

Next, the parameters in FIG. 2 are firstly explained, before the illustration of the specific steps of the automatic Gamma curve setting method of the present invention.

Parameter A (an automatic Gamma enable value). The automatic Gamma enable value is that when the image processing unit 210 receives the execution signal of the automatic Gamma enable value which is transmitted from the flex bus 220 through the bus bar, the image processing unit 210 executes the automatic Gamma action, in which the flex bus 220 captures the brightness and the color temperature of each pixels on the display panel 12 by using the calibration controller 40 of the light sensor (not shown), and the brightness and the color temperature of each pixels are operated by the micro processing controller (MCU) unit 30 to obtain the correct calibration value of the compensation value respectively. Therefore, the image processing unit 210 is communication with write and read to the FPGA 20 via the flex bus 220, and then the calibration value is written by the image processing unit 210 into the Block Ram (not shown) that is built in FPGA 20.

Parameter B (Highlight enable value). The parameter B is highlighted by the image highlight enable module 2108, which has two highlight modes. The first highlight mode, when the input image data is the gray scale image, the brightness of the original gray scale image is maintained, and the brightness of remaining color images (that is non-gray scale image) in the input image data are reduced. The second highlight mode, when the input image data is the color image, the brightness of the original color image is maintained, and the brightness of remaining gray scale images (that is, non-color image) are reduced.

Parameter C (Data Level). The Data Level ranges from 0~10). In the present invention, the RGB data can be 8 bits, 10 bits or 12 bits respectively, and the bit value of RGB data are corresponding to the various data level is described in detail as follows.

When the RGB data is 8 bits:

Data Level 0: the difference between the three values of RGB is less than or equal to 0;

Data Level 1: the difference between the three values of RGB is less or equal to 1;

Data Level 2: the difference between the three values of RGB is less or equal to 2;

Data Level 3: the difference between the three values of RGB is less or equal to 3;

. . .

Data Level 10: the difference between the three values of RGB is less or equal to 10.

When the RGB data is 10 bits:

Data Level 0: the difference between the three values of RGB is less or equal to 0;

Data Level 1: the difference between the three values of RGB is less or equal to 4;

Data Level 2: the difference between the three values of RGB is less or equal to 8;

Data Level 3: the difference between the three values of RGB is less or equal to 12;

. . .

Data Level 10: the difference between the three values of RGB is less or equal to 40.

When the RGB data is 12 bits:

Data Level 0: the difference between the three values of RGB is less or equal to 6;

Data Level 1: the difference between the three values of RGB is less or equal to 16;

Data Level 2: the difference between the three values of RGB is less or equal to 32;

Data Level 3: the difference between the three values of RGB is less or equal to 48,

. . .

Data Level 10: the difference between the three values of RGB is less or equal to 160.

Parameter D (data sensitivity). The data sensitivity ranges from 0-10. In the present invention, the data sensitivity is provided for determining the number of the consecutive pixels of the gray scale image, so as to allow the input image is normalized to belong to the gray scale image block. When the data sensitivity is smaller, the judgment value of the gray scale block is smaller. Conversely, when the data sensitivity is larger, the judgment value of the gray scale image block is larger. Accordingly, the data sensitivity will automatically calculate the judgment value of the gray scale image block according to the resolution of the display panel 12.

Data Sensitivity 0: 2 pixels;

Data Sensitivity 1: 4 pixels;

Data Sensitivity 2: the panel pixels/64 (pixels);

Data Sensitivity 3: the panel pixels/32 (pixels);

Data Sensitivity 4: the panel pixels/16 (pixels);

Data Sensitivity 5: the panel pixels/16 (pixels)+the panel pixels/32 (pixels);

Data Sensitivity 6: the panel pixels/8 (pixels);

Data Sensitivity 7: the panel pixels/8 (pixels)+the panel pixels/32 (pixels);

Data Sensitivity 8: the panel pixels/8+the panel pixels/16 (pixels);

Data Sensitivity 9: the panel pixels/8+the panel pixels/16 (pixels)+the panel pixels/32; and Data Sensitivity 10: the panel pixels/4 (pixels).

Parameter E (Gamma Data). The Gamma Data can be (1) there are multiple Black Rams in FPGA to store the calibrating and adjusting Gamma curve; (2) at the present, the specification of the actual image is mostly 10 bits, but the Gamma curve of the image can be performed with the underithering operation by the image underithering processing module 2104 to rise to up 18 bits, so that the color image is smoother and multi-colors within the color image. The multi-levels gray scale image can be clearly presented in gray scale image, that is, the gray level, the black level, and the white level that can be clearly presented and distinguished; and (3) the calibrated image Gamma curve of 18 bits is operated with the image by FPGA 20 to present the image value which meets the image value of the standard curve, the gray scale image is Gamma DICOM value, so that when the image is the composite image, the image can simultaneously display the gray scale image with multi-levels and the color image with multi-colors on the same display screen.

Parameter F (color temperature data). The calibrated and adjusted color temperature value is operated with the color temperature module 2106 to present the correct color temperature data by FPGA 20. The gray scale image includes a set of color temperature values, and the color image is another set of color temperature values, that is to say, each the gray scale image and the color image has different color temperature values, which can be simultaneously presented in the same display screen.

Next, please continue to refer to FIG. 2. The specific process of the automatic Gamma curve setting method of the present invention is described in detail as follows.

First, the input image data is inputted by the image input unit 10, and the RGB data decision module 2102 of the image input unit 10 is provided for detecting and selecting the input image data that is the color image, the gray image, or the composite images which include both gray scale image and the color image. In this step, the RGB data decision module 2102 determines the correlation between R (red) value, G (green) value, and B (blue) value of each pixel data to determine whether the each pixels is the gray scale value, if it is, the pixels is labeled as a gray scale flag and the gray scale flag value is set to 1, so that each pixels of the input image has its corresponding gray scale flag value. For example, first type, when R value is larger than G value and R value is larger than B value, if (R−G) value is less than Data Level, and (R−G) value is also less than Data Level, then the gray scale flag value of this pixel is labeled as 1. Second type: when R value is larger than G value, and R value is less than or equal to B value, if (R−G) value is less than Data Level, and (B−R) value is also less than Data Level, then the gray scale flag value of this pixel is labeled as 1. Third type: when R value is less than or equal to G value, and R value is larger than or equal to B value, if (G−B) value is less than Data Level, and (R−B) value is less than Data Level, then the gray scale flag value of this pixel is labeled as 1. Fourth type, when R value is less than or equal to G value and R value is less than or equal to B value, if (G−R) value is less than Data Level, and (B−R) value is less than Data Level, then the gray scale flag value of this pixel is labeled as 1. According to aforementioned, the above four embodiments are simply expressed by mathematic formula as follows:

First type: when R≥G and R≥B, if (R−G)<Data Level and (R−B)<Data Level, then the gray scale flag value of this pixel is 1;

Second type: when R≥G and R≤B, if (R−G)<Data Level and (B−R)<Data Level, then the gray scale flag value of this pixel is 1;

Third type: when R≤G and R≥B, if (G−B)<Data Level and (R−B)<Data Level, then the gray scale flag value of this pixel is 1; and Fourth type: when R≤G and R≤B, if (G−R)<Data Level and (B−R)<Data Level, then the gray scale flag value of this pixel is 1.

Next step is performed to calculate the gray scale consecutive maximum end vale of the plurality of pixels of the input image. This step utilizes the gray scale image detecting and decision module 2110 to count how many pixels in the input image are consecutively labeled with the gray scale flag value of 1. If the calculated gray scale flag value of the pixels is not labeled as 1, the total number of the gray scale flag of each pixels of the input image is returned to zero (that is, the counter is cleared) before the pixel with the gray scale flag value is not 1, and from the next pixel with the gray scale flag value is not 1 to re-calculate the gray scale consecutive maximum end value of the plurality of pixels of the input image. In this embodiment of the present invention, the gray scale consecutive maximum end vale is calculated by line buffer 2116. For example, 4K2K image is a combination of 3840×2160 pixels, which means there are 3840 pixels in a row and there are 2116 rows. The storage capacity of the line buffer 2116 is only set one row pixel image data size. When the image data is transferred to the line buffer 2116 and the image data is written into the line buffer 2116. Then, the gray scale consecutive maximum end value is calculated in the line buffer 2116. Next, the line buffer 2116 reads out the calculated gray scale consecutive maximum end value and transmits to the display panel. Because the data is updated once in each row in line buffer 2116 so that each pixel of the overall display screen can be under different gray scale enable values. With the update of different Gamma curve values and color temperature values, the user will not to view the changes in the display screen, while the display screen is being updated.

Next, the consecutive number of the input image is labeled as gray scale flag value (also can be regard as the gray scale image) is determined and the gray scale block of the gray scale image of the input image is also normalized according to the data sensitivity. When the data sensitivity is smaller, the gray scale block belongs to the input image is more smaller; else when the data sensitivity is larger, the gray scale block belongs to the input image is more larger, and when the gray scale consecutive maximum end value is larger than or equal to the data sensitivity, a gray scale enable value of the input image is set to 1.

The next step is performed to determine the automatic Gamma enable value of the input image. If the automatic Gamma enable value is 0, the overall input image which is not to be classified the gray scale image or the color image is performed with the image calibration and adjustment by the same Gamma curve value for the input image.

Thereafter, the step is to perform the image highlight enable to the input image. In this step, when the automatic Gamma enable value is 1 and the image highlight enable value is 0, then the automatic Gamma accurate function imaging is executed on the display screen to display the image. When the automatic Gamma enable value is 1 and the image highlight enable value is 1, then the input image is executed on the display screen belongs to a gray image that is maintained under an original brightness of the input image, and the remaining color images of the input image is reduced by 50% brightness. When the automatic Gamma enable value is 1 and the image highlight enable value is 2, then the input image is executed on the display screen belongs to the color image that is maintained under the original brightness of the input image, and the remaining gray scale image is reduced by 50% brightness. In this step, the user can clearly view and classify whether the image is the gray scale image or the color image by the image highlight function instantly, so as to the display screen can determine whether the input image is the gray scale image or the color image correctly according to the input image, and the user can view one of the gray scale image or the color image on the display screen through the image highlight enable value.

Finally, the different Gamma DICOM curve operations and the different color temperature operations are performed on the same display screen according to the gray scale enable value, so that the input image is to be an image data which conforms with the curve and standard after Gamma DICOM curve operations and the color temperature operations, and the calculated image is transmitted to the display panel (the image output unit) 12 on the same display screen to obtain the input image which is calculated by Gamma curve calculation to be outputted. This step is performed with the Gamma DICOM LUT 2114 and the color temperature module 2106 to perform the different Gamma DICOM curve operations and the different color temperature operations on the same display screen based on the gray scale enable value.

According to the gray scale enable value is performed to above steps of different Gamma DICOM curve operations and the different color temperature operations are performed on the same image screen, when the automatic Gamma enable value is 1 and the image highlight enable value is 0, if the gray scale enable value of input image of 1 are calculated via the Gamma DICOM curve operations and the color temperature operations, the operated image (that is, calculated image) is transmitted to the display panel (image output unit) 12, so that the display panel (image output unit) 12 can display the image on the display screen, in which the displayed image is calibrated by Gamma DICOM curve calculation.

In another embodiment of the present invention, in the step of the gray scale enable value is performed to above steps of different Gamma DICOM curve operations and the different color temperature operations are performed on the same display screen, if the automatic Gamma enable value is 1, the image highlight enable value is 0 and the input image with the gray scale enable value of 0 is operated by Gamma curve value stored in the RAM (random access memory), and the image is transmitted to the display panel (image output unit) 12 after the color temperature operations, so as to the image which has been calibrated by the Gamma curve automatic calibration is displayed on the display panel 12. In this embodiment, the color temperature ranges from 1800K~18000K, and the common color temperature is 6500K, 7500K, 8200K, or 9300K. The Gamma look-up table 2112 is stored in the RAM, and a plurality of Gamma curve value are stored in the Gamma look-up table, which may be Gamma 1.0~Gamma 4.0, and the common Gamma value is Gamma 1.8, Gamma 2.0 or Gamma 2.2.

In another embodiment of the present invention, in the same execution screen, according to the step of the gray scale enable value is performed to above steps of different Gamma DICOM curve operations and the different color temperature operations as described above, the input image which is performed by Gamma curve operations and the color temperature operations, and then the operated input image is conformed with the curve value and the standard to be an image display value, so as to allow that the display panel 12 outputs and displays the calibrated image based on the image display value.

According to the above execution steps, the types of the input image can be automatically detected in an instant without delay, such as the gray scale image, the color image or the composite image having both the grayscale image and the color image. In addition, according to R value, G value, and B value of each pixel of the input image are used to calculate relevant parameters of the image to be calibrated according to the present invention, such as an automatic gamma enable value, an image highlight enable value, a Data Level, a data sensitivity, a Gamma value, and a color temperature value. The corresponding Gamma curve and color temperature are automatically executed to calibrate the input image, so that the color image is adjusted to improve its smoothness and multi-color rendering, and the gray scale image can be clearly adjusted to present multi-level gray scale images, thereby, this automatic Gamma curve setting method and system can provide a correct diagnostic platform for the user especially for the doctor.

Although specific embodiments have been illustrated and described, it will be obvious to those skilled in the art that various modifications may be made without departing from what is intended to be limited solely by the appended claims

What is claimed is:

1. An automatic Gamma curve setting method applied for a monitor, comprising:

providing an input image by a display panel, the input image includes a plurality of pixels;

determining the correlation between a R(red) value, a G(green) value and a B(blue) value of each the plurality of pixels of the input image to judgment whether each of the plurality of pixels is a gray scale value or not, if the pixels is determined as the gray scale value, the pixels is labeled with a gray scale flag, and such the value of the gray scale flag is set to 1, so that each pixels of the input image has its corresponding gray scale flag value;

calculating a gray scale consecutive maximum end value of the plurality of pixels of the input image, wherein counting the number of each pixels that is labeled as the gray scale flag value is 1, if the gray scale flag value of each pixels is not labeled as 1, the total number of the gray scale flag of each pixels of the input image prior the pixel with the gray scale flag value is returned to zero, and from the next pixel with the gray scale flag value is not 1 to recalculate the gray scale consecutive maximum end value of the plurality of pixels of the input image;

determining the input image as a consecutive number of pixel is labeled with the gray scale flag value according to a data sensitivity and normalizing a gray scale block to the number of pixels of the input image, when the data sensitivity is smaller, the gray scale block belongs to the input image is more smaller, else when the data sensitivity is larger, the gray scale block belongs to the input image is more larger, and when the gray scale consecutive maximum end value is larger than or equal to the sensitivity value, a gray scale enable value of the input image is set to 1;

determining an automatic Gamma enable value and an image highlight enable value of the input image, if the automatic Gamma enable value is 1 and the image highlight enable value is 0, the automatic Gamma correct function imaging is maintained on an execution screen of the display, if the automatic Gamma enable value is 1 and the image highlight enable value is 1, then the input image on the execution screen of the monitor belongs to a gray scale image that is maintained under an original brightness of the input image and the remaining colored images of the input image is reduced by 50% brightness; if the automatic Gamma enable is 1 and the image highlight enable value is 2, then the input image on the execution screen of the display belongs to a color image that is maintained under an original brightness of the input image, and the remaining gray scale images of the input image are reduced by 50% brightness; and performing different Gamma DICOM curve operations and different color temperature operations on the execution screen of the monitor according to the gray scale enable value, so that the input image is processed to become an image data that is conformed to a curve and a standard, and a calibrated image is transmitted to an image output unit to display an outputted image which is calibrated by the Gamma curve on the same execution screen of the monitor.

2. The method according to claim 1, wherein the R (red) value, the G (green) value, and the B (blue) value can be 8 bits, 10 bit, or 12 bits.

3. The method according to claim 1, wherein the sensitivity value ranges from 0-10.

4. The method according to claim 3, wherein the sensitivity value varies with a resolution of the image output unit.

5. The method according to claim 4, wherein the image output unit is a display panel.

6. The method according to claim 1, wherein the sensitivity value varies with a resolution of the image output unit.

7. The method according to claim 1, wherein the step of performing different Gamma DICOM curve operations and different color temperature operations on the execution screen of the display according to the gray scale enable value, when the automatic Gamma enable value is 1 and the image highlight enable value is 0, the input image with the gray scale enable value of 1 is operated by the Gamma DICOM curve operations and the color temperature operations that is outputted by the image output unit.

8. The method according to claim 7, wherein the color temperature ranges from 1800K~18000K.

9. The method according to claim 1, wherein the step of performing different Gamma DICOM curve operations and different color temperature operations on the execution screen of the display according to the gray scale enable value, when the automatic enable value is 1 and the image highlight enable value is 0, the input image with the gray scale enable value of 0 is operated by the Gamma curve operations and the color temperature operations that is outputted by the image output unit.

10. The method according to claim 9, wherein the color temperature ranges from 1800K~18000K.

11. The method according to claim 10, wherein the Gamma curve value ranges from Gamma 1.0-Gamma 4.0.

* * * * *